US010231052B2

(12) United States Patent
Jeffery et al.

(10) Patent No.: US 10,231,052 B2
(45) Date of Patent: Mar. 12, 2019

(54) ACOUSTIC DEVICE

(71) Applicant: Bose Corporation, Framingham, MA (US)

(72) Inventors: Nathan Jeffery, Boston, MA (US); Roman N. Litovsky, Newton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/790,401

(22) Filed: Oct. 23, 2017

(65) Prior Publication Data

US 2018/0048960 A1 Feb. 15, 2018

Related U.S. Application Data

(63) Continuation of application No. 15/174,086, filed on Jun. 6, 2016, now Pat. No. 9,838,787.

(51) Int. Cl.

| | |
|---|---|
| ***H04R 1/10*** | (2006.01) |
| ***H04R 1/20*** | (2006.01) |
| ***H04R 5/02*** | (2006.01) |
| ***H04R 3/12*** | (2006.01) |
| ***H04R 1/40*** | (2006.01) |
| ***H04R 1/34*** | (2006.01) |

(52) U.S. Cl.

CPC ..... *H04R 3/12* (2013.01); *H04R 1/1091* (2013.01); *H04R 1/345* (2013.01); *H04R 1/403* (2013.01); *H04R 5/02* (2013.01); *H04R 1/1083* (2013.01); *H04R 1/20* (2013.01); *H04R 2201/10* (2013.01); *H04R 2201/405* (2013.01)

(58) Field of Classification Search

CPC ..... H04R 1/1091; H04R 1/345; H04R 1/403; H04R 3/12; H04R 1/1083; H04R 1/20; H04R 2201/10; H04R 2201/405; H04R 5/02

USPC ..... 381/314–318, 370, 380, 381

See application file for complete search history.

(56) References Cited

U.S. PATENT DOCUMENTS 3,796,840 A * 3/1974 Ohta ..... H04R 1/1075 381/19
5,617,477 A * 4/1997 Boyden ..... H04R 3/12 381/309
8,767,996 B1 * 7/2014 Lin ..... H04R 1/1091 381/370
9,838,787 B1 * 12/2017 Jeffery ..... H04R 5/02
(Continued)

FOREIGN PATENT DOCUMENTS

DE 102014207945 A1 * 10/2015 ..... H04R 1/1008

*Primary Examiner* — Curtis A Kuntz
*Assistant Examiner* — Julie X Dang
(74) *Attorney, Agent, or Firm* — Brian M. Dingman; Dingman IP Law, PC

(57) ABSTRACT

An acoustic device that is adapted to be worn on the body of a user, with a first acoustic transducer and a second acoustic transducer, where the first transducer is closer to the expected location of a first ear of the user than is the second transducer, a third acoustic transducer and a fourth acoustic transducer, where the third transducer is closer to the expected location of a second ear of the user than is the fourth transducer, and a controller that is adapted to independently control the phase and frequency response of the first, second, third and fourth transducers.

25 Claims, 14 Drawing Sheets

(56) References Cited

U.S. PATENT DOCUMENTS

| | | | | |
|---|---|---|---|---|
| 2001/0031062 | A1* | 10/2001 | Terai | H04R 5/033<br>381/370 |
| 2003/0048915 | A1* | 3/2003 | Bank | H04M 1/05<br>381/326 |
| 2009/0205900 | A1* | 8/2009 | Purcell | A61F 11/14<br>181/129 |
| 2014/0039576 | A1* | 2/2014 | Hillbratt | H04R 25/505<br>607/57 |

* cited by examiner

ACOUSTIC DEVICE

CROSS-REFERENCE TO RELATED APPLICATION

This application is a continuation of and claims priority to application Ser. No. 15/174,086 filed on Jun. 6, 2016, the entire disclosure of which is incorporated herein by reference.

BACKGROUND

This disclosure relates to an acoustic device.

Headphones are typically located in, on or over the ears. One result is that outside sound is occluded. This has an effect on the wearer's ability to participate in conversations as well as the wearer's environmental/situational awareness. It is thus desirable at least in some situations to allow outside sounds to reach the ears of a person using headphones.

Headphones can be designed to sit off the ears so as to allow outside sounds to reach the wearer's ears. However, in such cases sounds produced by the headphones can become audible to others. When headphones are not located on or in the ears, it is preferable to inhibit sounds produced by the headphones from being audible to others.

SUMMARY

The acoustic device disclosed herein has at least two acoustic transducers close to each side of the head and off the ears, so that the wearer can hear conversations and other environmental sounds. Generally, but not necessarily, the transducers are both within a few inches of the head. The transducers are arranged such that one of the two is close to the ear (generally but not necessarily, about an inch or two from the ear) and generally pointed at or towards the ear, so that its output creates a sound pressure level (SPL) at the ear. The second transducer is close to the first transducer but farther from the ear such that it has minimal impact on the sound delivered to the ear but can contribute to far-field sound cancellation, at least at some frequencies. The transducers are driven separately, with separate control of the phase and frequency response. This allows the output of the acoustic device to be tailored to meet requirements of the user with respect to the desired SPL at the ears, the acoustic environment, and the need to inhibit or prevent radiated acoustic power.

All examples and features mentioned below can be combined in any technically possible way.

In one aspect, an acoustic device that is adapted to be worn on the body of a user includes a first acoustic transducer and a second acoustic transducer, where the first transducer is closer to the expected location of a first ear of the user than is the second transducer, and a third acoustic transducer and a fourth acoustic transducer, where the third transducer is closer to the expected location of a second ear of the user than is the fourth transducer. There is a controller that is adapted to independently control the phase and frequency response of the first, second, third and fourth transducers.

Embodiments may include one of the following features, or any combination thereof. The first acoustic transducer may be adapted to radiate sound along a first sound axis and the second acoustic transducer may be adapted to radiate sound along a second sound axis, where the first sound axis is pointed generally toward the expected location of the first ear and the second sound axis is pointed generally away from the expected location of the first ear. The first and second sound axes may be generally parallel. The third acoustic transducer may be adapted to radiate sound along a third sound axis and the fourth acoustic transducer may be adapted to radiate sound along a fourth sound axis, where the third sound axis is pointed generally toward the expected location of the second ear and the fourth sound axis is pointed generally away from the expected location of the second ear. The third and fourth sound axes may be generally parallel.

Embodiments may include one of the following features, or any combination thereof. The first acoustic transducer may be adapted to radiate sound along a first sound axis and the second acoustic transducer may be adapted to radiate sound along a second sound axis, where the first and second sound axes are both pointed generally toward the expected location of the head proximate the first ear. The first and second sound axes may be generally parallel. The third acoustic transducer may be adapted to radiate sound along a third sound axis and the fourth acoustic transducer may be adapted to radiate sound along a fourth sound axis, where the third and fourth sound axes are both pointed generally toward the expected location of the head proximate the second ear. The third and fourth sound axes may be generally parallel.

Embodiments may include one of the following features, or any combination thereof. The second transducer may be at least about two times farther from the first ear than is the first transducer. The first and second transducers may both be carried by a first enclosure and the third and fourth transducers may both be carried by a second enclosure. The acoustic device may further comprise a first resonant element coupled to the first enclosure and a second resonant element coupled to the second enclosure. At least one of the first and second resonant elements may comprise a port or a passive radiator.

Embodiments may include one of the following features, or any combination thereof. All four transducers may be acoustically coupled to a waveguide. The acoustic device may further comprise an open tube that is acoustically coupled to the waveguide. The waveguide may have two ends, a first end adapted to be located at one side of the head and in proximity to the expected location of the first ear, and a second end adapted to be located at another side of the head and in proximity to the expected location of the second ear. The first and second transducers may both be carried by a first enclosure that is at the first end of the waveguide, and the third and fourth transducers may both be carried by a second enclosure that is at the second end of the waveguide.

Embodiments may include one of the following features, or any combination thereof. The controller may be adapted to establish first, second and third different signal processing modes. In the first signal processing mode the first and second transducers may be played out of phase from each other, and the third and fourth transducers may be played out of phase from each other. In the first signal processing mode the first and third transducers may be played in phase with each other. In the first signal processing mode audio signals for the second and fourth transducers may be low-pass filtered, where the low pass filter has a knee frequency. The first and second transducers may be spaced apart by a first distance, and the knee frequency may be approximately equal to the speed of sound in air divided by four times this first distance. In the second signal processing mode the first and second transducers may be played in phase with each other, and the third and fourth transducers may be played in phase with each other, and the first and second transducers may be played out of phase with the third and fourth transducers. In the third signal processing mode all four transducers may be played in phase with each other.

In another aspect an acoustic device that is adapted to be worn on the body of a user includes a first acoustic transducer and a second acoustic transducer, where the first transducer is closer to the expected location of a first ear of the user than is the second transducer, and the second transducer is at least about two times farther away from the first ear than is the first transducer. There is a third acoustic transducer and a fourth acoustic transducer, where the third transducer is closer to the expected location of a second ear of the user than is the fourth transducer, and the fourth transducer is at least about two times farther away from the second ear than is the third transducer. A controller is adapted to independently control the phase and frequency response of the first, second, third and fourth transducers, and is further adapted to establish first, second and third different signal processing modes.

In another aspect, an acoustic device that is adapted to be worn on the body of a user includes a first acoustic transducer and a second acoustic transducer, where the first transducer is closer to the expected location of a first ear of the user than is the second transducer, and a third acoustic transducer and a fourth acoustic transducer, where the third transducer is closer to the expected location of a second ear of the user than is the fourth transducer. There is a controller that is adapted to independently control the phase and frequency response of the first, second, third and fourth transducers. The controller is further adapted to establish first, second and third different signal processing modes. In the second signal processing mode the first and second transducers are played in phase with each other and the third and fourth transducers are played in phase with each other, and the first and second transducers are played out of phase with the third and fourth transducers. In the third signal processing mode all four transducers are played in phase with each other.

DETAILED DESCRIPTION

This disclosure describes a body-worn acoustic device that comprises four (or more) acoustic transducers, with at least two transducers on each side of the head, close to but not touching the ear. The device can be worn on the head (e.g., with the transducers carried by a headband or another structure), like an off-the-ear headphone, or the device can be worn on the body, particularly in the neck/shoulder area where the transducers can be pointed toward the ear(s). One transducer on each side of the head is closer to the expected location of the ear (depicted as transducer "A" in some drawings) and one is farther away from the ear (depicted as transducer "B" in some drawings). In one non-limiting example the A transducers are arranged such that they radiate sound along an axis that is pointed generally toward the ear, and the B transducers are arranged such that they radiate sound along an axis that is pointed generally away from the ear (e.g., 180° from the A axis in some non-limiting examples). The A transducers, being closer to the ear, will be the dominant source of sound received at the ear (shown as "E" in some drawings). The B transducers are farther away from the ear, and as such contribute less to creating sound at the ear. The B transducers are close to the A transducers, and so can contribute to the far-field cancellation of at least some of the radiated output of the A transducers. Accordingly, the acoustic device can be located off the ears and still provide quality audio to the ears while at the same time inhibiting far-field sound that can be heard by others who may happen to be located close to the user of the acoustic device. The acoustic device thus can effectively operate as open headphones, even in quiet environments.

The acoustic device allows for independent control of all four transducers. The phase relationship between the transducers is modified to obtain different listening "modes," and to achieve different trade-offs between maximizing the SPL delivered to the ear and minimizing the total radiated acoustic power to the far-field (normalized to the SPL at the ear), also known as "spillage."

Figure 1:
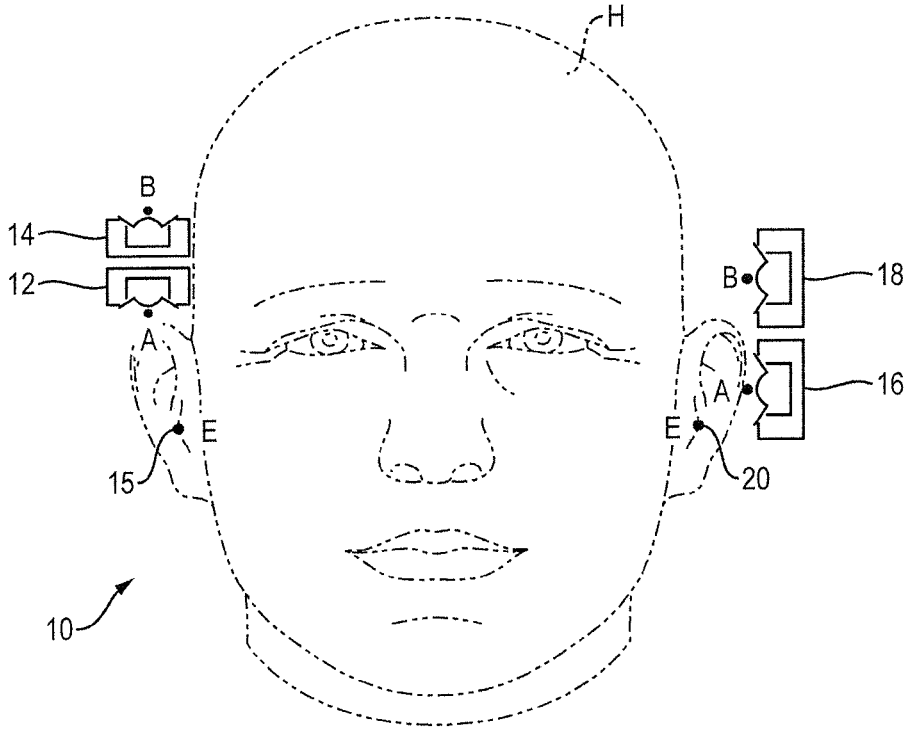
FIG. 1 is schematic drawing of alternative configurations for an acoustic device.

FIG. 1 shows a simplified representation of transducers "A" (12, 16) and "B" (14, 18), shown as monopole sources (e.g., drivers in a sealed enclosure or box which function to radiate sound approximately equally in all directions). Transducers A and B can also be represented as ideal point source monopoles (represented by the dots). Also shown is the location of the ear, E. The distance between A and B can be defined as "d", the distance between A and E can be defined as "x", and the distance between B and E can be defined as "D".

Transducers 12 and 14 illustrate one implementation of the right-ear/head (H) side of acoustic device 10. Transducers A (12) and B (14) may be each contained within their own separate acoustic enclosure containing just the driver and a sealed volume of air. This is an idealized configuration, and is only one of many possible configurations, as is further described below. Transducer A is close to ear E (15) and generally pointed at ear 15, while transducer B is close to transducer A but generally pointed away from ear 15. In this implementation, the transducers are situated above the ear, with the normal direction of the transducer diaphragms pointing vertically up and down and pointing down towards the ear. Another implementation is depicted on the left-ear side, with transducers A (16) and B (18), both pointed at the head, with A closer to the ear E (20) than B. In this implementation, the transducers are situated to the side of the ear, with the normal direction of the transducer diaphragms pointing horizontally towards the ear. Note that FIG. 1 is meant to illustrate two different transducer arrangements, whereas a real-world acoustic device would likely have the same transducer arrangements on both sides of the head.

A controller can be used to separately control the phase and frequency response of each of the four transducers. This provides for a number of different listening "modes", several non-limiting examples of which are illustrated in Table 1 below, where the + and − symbols indicate the relative phases of the transducers. The control necessary to achieve each mode can be predetermined and stored in memory associated with the controller. Modes can be automatically or manually selectable.

TABLE 1

| | Transducer Phase | | | |
|---|---|---|---|---|
| | Right Ear | | Left Ear | |
| | Transducer A | Transducer B | Transducer A | Transducer B |
| Quiet Mode 1 | + | − | + | − |
| Quiet Mode 2 | − | + | + | − |
| Normal Mode | + | + | − | − |
| Loud Mode | + | + | + | + |

A first mode can be termed a "quiet mode" in which the SPL at the ears is low (relative to the other modes), and spillage is reduced across a wide range of frequencies. In quiet mode, A and B are played out of phase on both the left and right sides. Two such examples are shown above in Table 1 (Quiet Mode 1 and Quiet Mode 2), but other quiet modes are possible as long as A and B are played out of phase on each side of the head. In quiet mode, the dipole effect between A and B on each side of the head creates far-field cancellation over a certain bandwidth of frequencies, which can be defined by the distances between the transducers, d. However, this mode is limited in output level due to the need to move a large amount of air to achieve low frequency performance. The difference between the two quiet mode implementations shown in Table 1 (Quiet Mode 1 and Quiet Mode 2) is the relative phase of the A and B transducers on opposite sides of the head: for Quiet Mode 1 transducers A are in phase for both ears and for Quiet Mode 2 they are out of phase. Similarly, for Quite Mode 1 transducers B are in phase for both ears and for Quiet Mode 2 they are out of phase. These phase differences have little effect on power efficiency but provide a tool to affect spatial perception of sound for the wearer, creating either "in head" (mode 1) or "out of head" (mode 2) sound images.

The bandwidth of the far-field dipole cancellation effect is limited by the distance between sources A and B. The ability to cancel begins to significantly diminish when the quarter-wavelength of the signal approaches the distance between the sources (here shown as d):

$$\lambda/4 \approx d \qquad \text{(equation 1)}$$

The frequency at which this occurs, where c is the speed of sound in air (345 m/s), is:

$$f_{cancel} \approx c/\lambda \approx c/(4*d) \qquad \text{(equation 2)}$$

As an example, if the distance between the sources is 0.025 m (almost 1"), then above around 3,450 Hz the sources radiate sound as two separate monopoles and there is less far-field cancellation.

Figure 9:
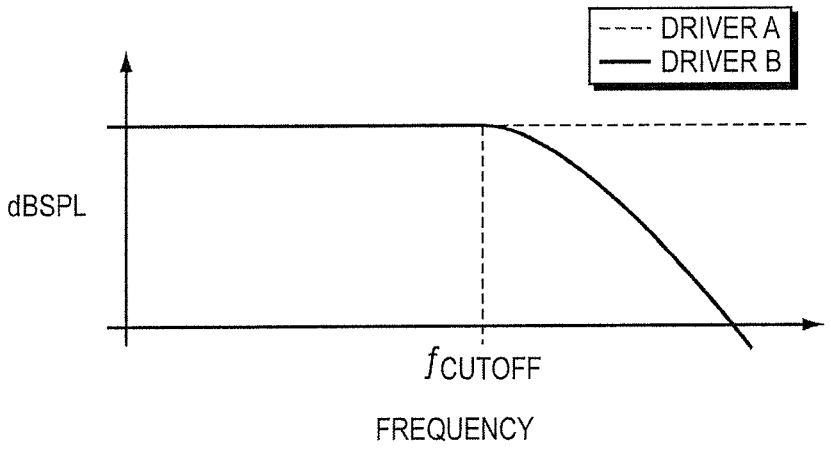
FIG. 9 illustrates the effect of a low-pass filter on the output of an acoustic device.

Because of this fact, and since the primary function of source B is to cancel source A rather than to contribute SPL at the ear, above the frequency $f_{cancel}$ source B radiation is not beneficial and could have the additional detrimental effect of radiating unwanted "spillage" audio that could be bothersome to others around the wearer of the acoustic device. To address this, in quiet mode the signal of transducer (driver) B could be filtered with a low-pass filter with a knee frequency ($f_{cutoff}$) at or close to $f_{cancel}$. FIG. 9 is a simplified representation of the final frequency response of transducer (driver) B in this case, with a low-pass filter applied, as compared to that of transducer (driver) A.

Quiet mode is useful for situations where low listening volumes are acceptable and where reducing spillage is important. However, in the quiet modes described thus far, transducer B is radiating a destructive signal to the ear and in part canceling the output from transducer A. The magnitude of this cancelation is related to the ratio of distances from each transducer to the ear. The expression in equation 3 below describes that the ratio of the acoustic pressure ($P_A$, $P_B$) to the ear that originates from each transducer is related inversely to the ratio of the distances from each transducer to the ear.

$$\left|\frac{p_{B\ to\ ear}}{p_{A\ to\ ear}}\right| = \frac{x}{D} \qquad \text{(equation 3)}$$

For example, if x=1" and D=3", then x/D=1/3 and therefore transducer B will contribute 1/3 as much pressure to the ear as transducer A. This means that if transducer A contributes 1 unit of pressure, then transducer B contributes 1/3 units of pressure. When the two transducers are in phase, and at sufficiently low frequencies (for example, below about 100 Hz), the superposition of the pressure fields will produce 4/3 units of pressure at the ear. However, when they are out of phase by 180° then the result at the ear will be 2/3 units of pressure. Accordingly, in the quiet modes described thus far, this means that in exchange for cancelling the output to the far field by using transducer B out of phase with transducer A, the device is only achieving 50% of the pressure that it is capable of producing when driven with A and B in-phase.

In some situations, it may be desirable to take advantage of the system's capability to produce higher sound pressure levels at the ears, with a tradeoff in terms of the bandwidth of far-field cancellation. Accordingly, the device can be capable of another mode (termed "normal mode") where transducers A and B are played in phase on each side of the head, but the left side transducers are played out of phase with the right side transducers, thus still taking advantage of a dipole effect for far-field cancellation. See table 1, which shows one example of a normal mode where transducers A and B on the left side are both played in phase, while transducers A and B on the right side are both played out of phase. Because of the increased distance between the effective monopoles on each side of the head, the far-field cancellation is only effective at lower frequencies (compared to Quiet mode). For example, whereas in the quiet mode example the distance of 0.025 m resulted in cancellation up to about 3,450 Hz, in this case the distance between the two sides of the head might be closer to 0.150 m with corresponding cancellation up to about 575 Hz.

Normal mode has output limitations at low frequencies for the same reasons as explained for Quiet mode. In some situations, it may be desirable to produce even higher sound pressure levels by playing each of the transducers in phase, particularly in situations where it is not important to reduce spillage. Accordingly, the device can be capable of another mode (termed "loud mode") that achieves maximum possible acoustic output with no cancellation by using all four drivers in phase with each other. See Table 1.

Figure 2:
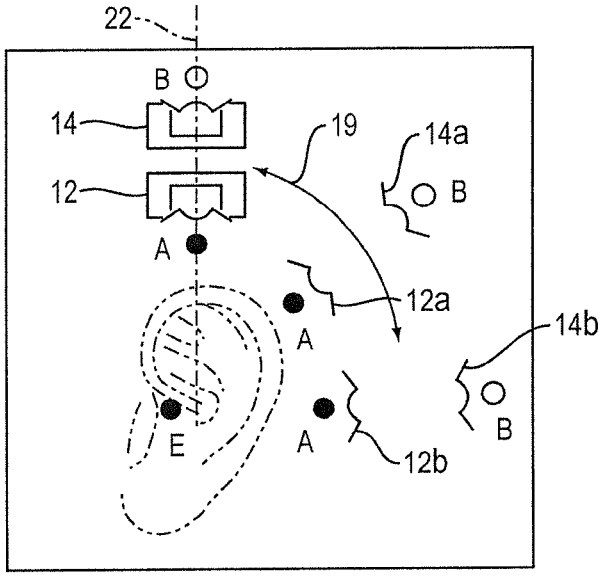
FIG. 2 is schematic drawing of alternative locations for the transducers of one example of an acoustic device.
Figure 3:
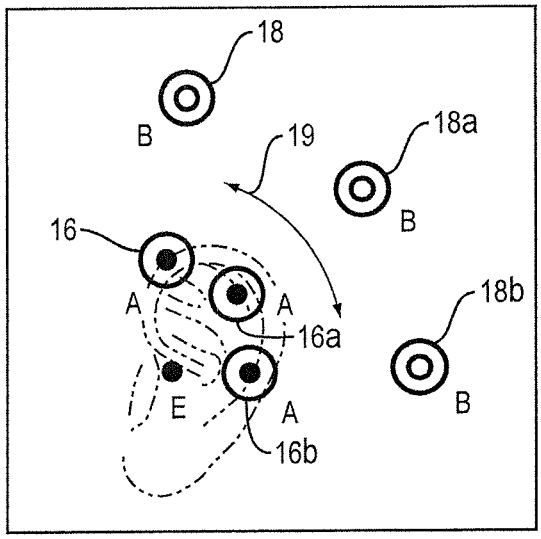
FIG. 3 is schematic drawing of alternative locations for the transducers of a second example of an acoustic device.

FIGS. 2 and 3 illustrate several non-limiting physical orientations of transducers A and B. FIG. 2 illustrates orientations for the general configuration shown on the right side (close to ear 15) of FIG. 1, where transducers 12 (A) and 14 (B) both radiate along axis 22, with transducer 12 pointed at or close to ear E and transducer 22 pointed 180° away but along the same (or, a generally parallel) axis. FIG. 2 shows three different possible orientations of transducers A and B and the corresponding sealed boxes. In one orientation (FIG. 2) the transducers 12 (A) and 14 (B) are situated above the ear (generally in the same plane as the ear), with the normal direction of the transducer diaphragms pointing vertically up and down and pointing at the ear. FIG. 3 illustrates orientations for the general configuration shown on the left side (ear 20) of FIG. 1, where transducers A (16) and B (18) are both pointed at the head, with A closer to the ear E (20) than B. In this orientation the transducers 16 (A) and 18 (B) are situated to the side of the ear/head (in a different, but generally parallel, plane than the ear), with the normal direction of both transducer diaphragms pointing horizontally towards the ear or the head.

These two orientations can also be rotated 360 degrees around the ear to provide different form factor possibilities. FIGS. 2 and 3 illustrate non-limiting examples in which both of the orientations illustrated in FIG. 1 are situated through a roughly 90 degree sweep of angles along arc 19 (see paired placements 12*a* and 14*a*, and 12*b* and 14*b*, FIG. 2, and placements 16*a* and 18*a*, and 16*b* and 18*b*, FIG. 3).

The general goals of the placement of the transducers are as follows. The distance from transducer A to the ear (x) is to be minimized. This allows for minimal spillage. The ratio of distances from B-E relative to A-E should be >≈2, or $$\frac{D}{x} > 2 \qquad \text{(equation 4)}$$

This allows for transducer A to be the dominant source of sound at the ear. The distance from transducer A to transducer B (d) is to be minimized. This allows for cancellation up to higher frequencies. These goals can be in conflict with one another in practice and the particular trade-offs of the design need to be weighed.

Figure 4:
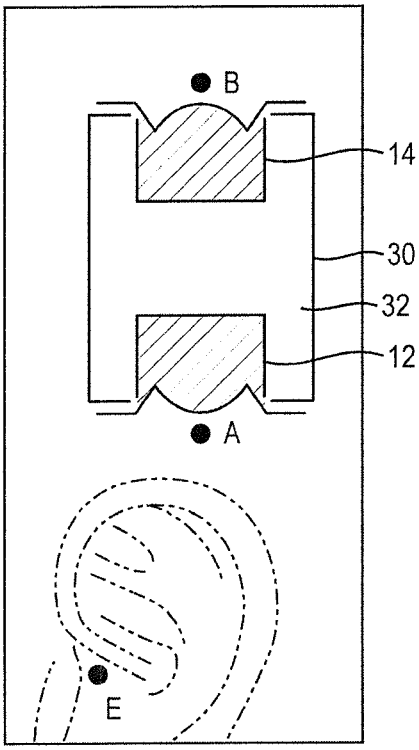
FIG. 4 is schematic drawing of an enclosure for an example of an acoustic device.

Thus far, only an acoustic implementation that comprises four separate sealed boxes, each with its own transducer, has been discussed. In practice, the power efficiency of a system with separate sealed enclosures is not ideal for reproducing full bandwidth audio, especially when there are tight constraints on size due to style and comfort concerns. This is mostly due to the power required to compress the air in a small enclosure. One first step at improving this would be to combine the two separate enclosures into one enclosure 30 with interior 32, as shown in FIG. 4. This will allow for less air compression and impedance in Quiet mode.

Figure 5A:
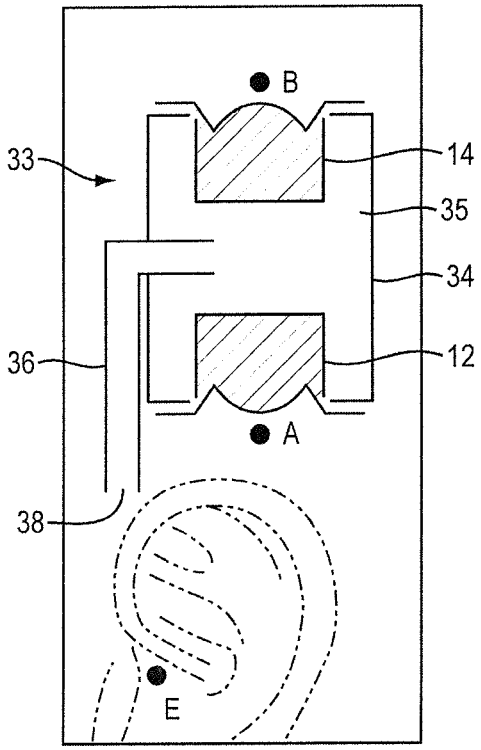
FIGS. 5A and 5B are schematic drawings illustrating one type of resonant element for an acoustic device.
Figure 5B:
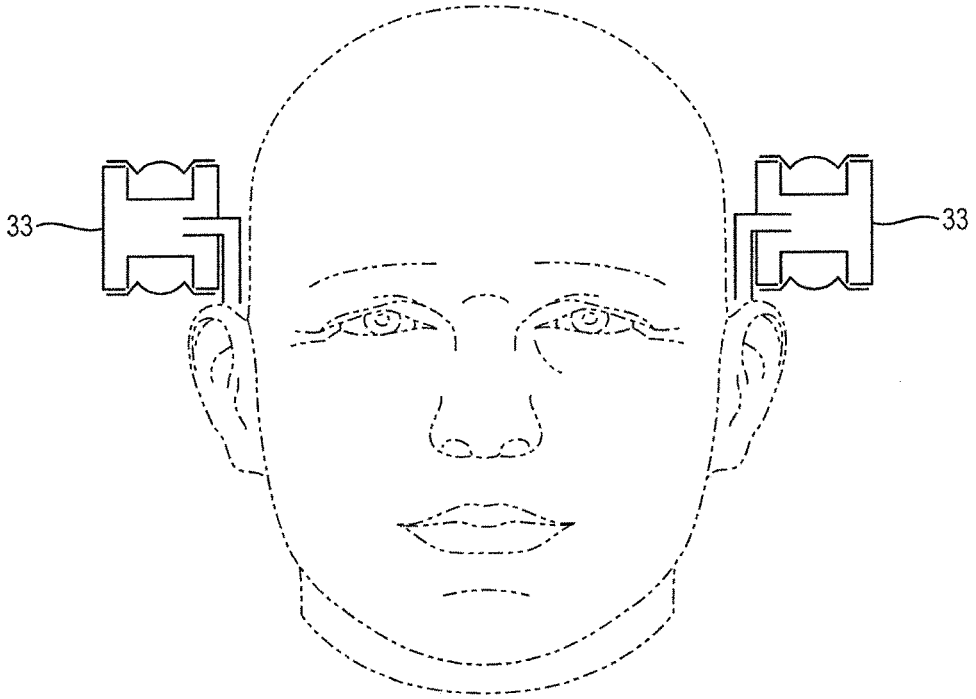

To do even better on efficiency, one or more resonant elements can be added to the enclosure. Resonant elements such as ports, passive radiators and waveguides are known in the art. For example, device 33, FIG. 5A, comprises enclosure 34 with interior 35. Port 36 communicates with interior 35 and has an open end 38 near ear E. This will improve power efficiency at frequencies near to the resonance of the system when both transducers on each side of the head are in phase—in Normal and Loud modes. The output of the resonant element should be placed as near as possible to the ear in order to reduce the necessary output from that element for a given SPL delivered to the ear. FIG. 5B shows an implementation using devices 33 (each comprising a ported enclosure) on both sides of the head, just above or otherwise near the ear (using, e.g., any of the configurations previously described).

Figure 6:
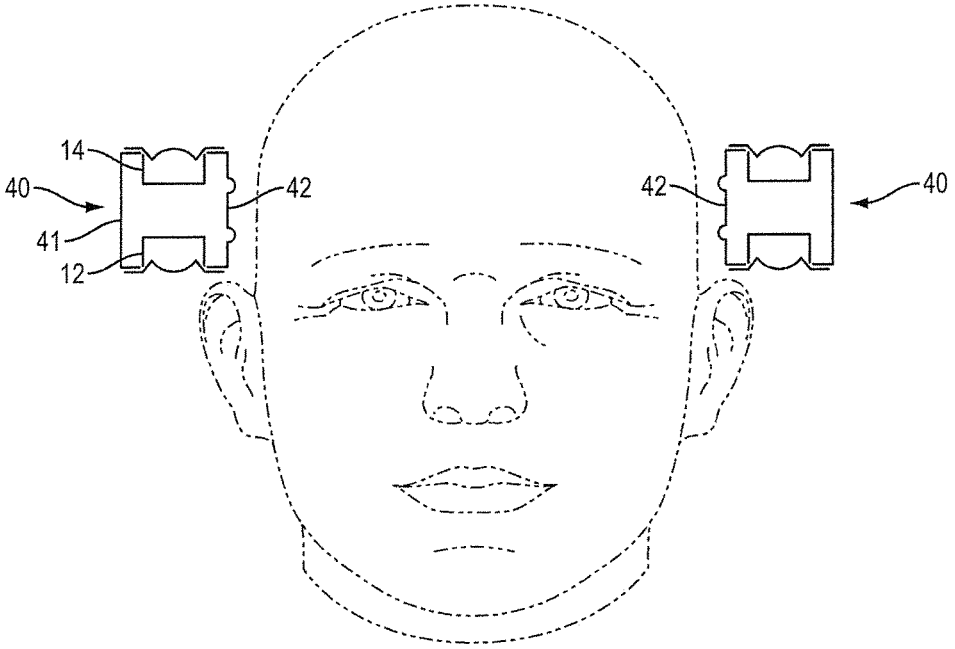
FIG. 6 is schematic drawing of another type of resonant element for an acoustic device.

An acoustic device that uses passive radiators as the resonant element is illustrated in FIG. 6. Each device 40 comprises an enclosure 41 that carries transducers 12 and 14. Each enclosure also carries one or more passive radiators. In this non-limiting example, passive radiator 42 is on the side of enclosure 41 facing the head, but in alternative configurations, a pair of balanced passive radiators could be used as the resonant element. The passive radiator(s) should ideally be positioned close to the ear.

Figure 7:
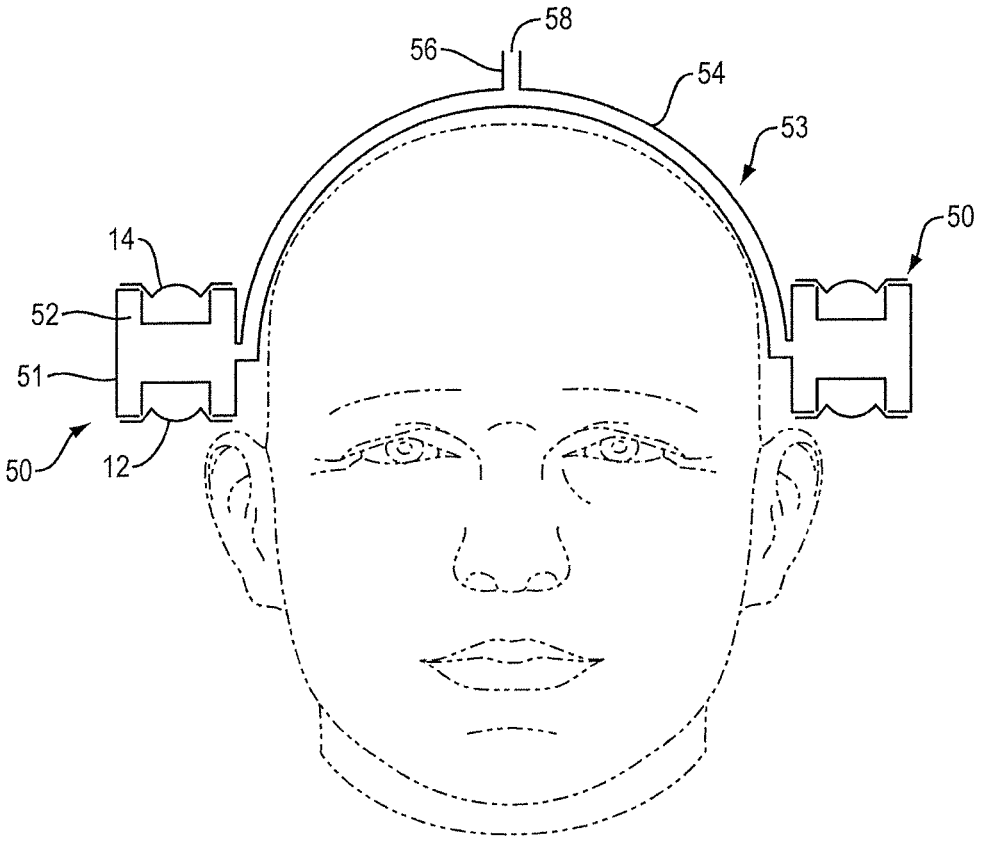
FIG. 7 is schematic drawing of another type of resonant element for an acoustic device.

An acoustic device that uses a waveguide as a resonant element is shown in FIG. 7. Acoustic device 53 comprises devices 50 on each side of the head, each comprising enclosure 51 carrying transducers 12 and 14. Enclosures 51 are acoustically coupled to waveguide 54. For the quiet mode the waveguide does not have an acoustic effect, but for normal mode the waveguide connects the left and right sides and allows the air to transfer back and forth which improves efficiency by avoiding air compression. In the loud mode, to improve efficiency there needs to be an exit for air. The exit is ideally but not necessarily at the midpoint of waveguide 54, as depicted by port 56 with opening 58. Port 56 can also potentially provide an additional length of waveguide to lower the tuning frequency.

Figure 8:
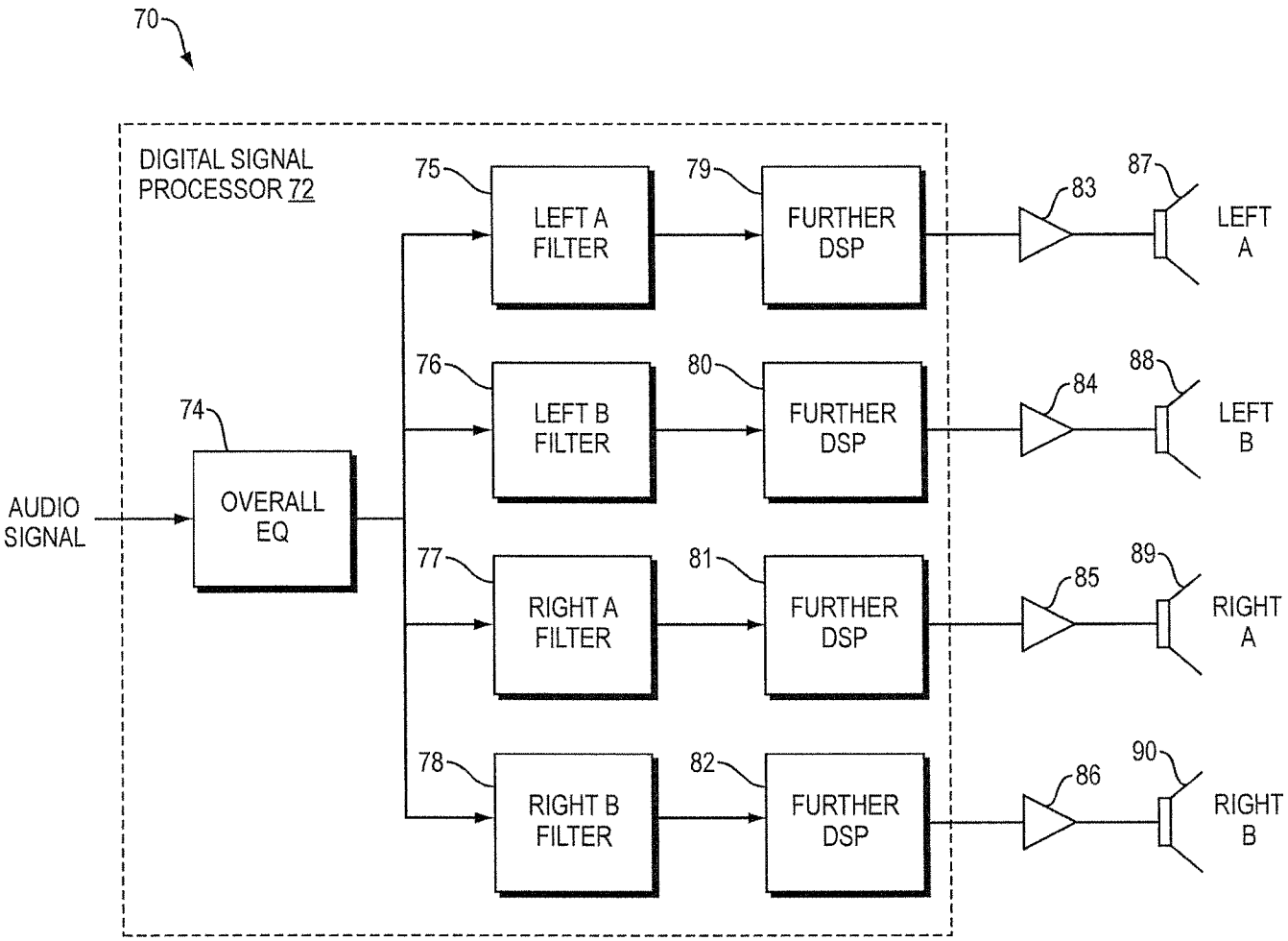
FIG. 8 is a schematic block diagram of an acoustic device.

The acoustic device can but need not feature a number of different, predefined signal processing modes, each of which can independently control the frequency response and relative phase (and potentially but not necessarily the amplitude) of each of the transducers. Switching between the modes can either be done in response to increases in volume from a user request, or feature another method of switching between modes of operation, either using a switch or other user interface feature on the acoustic device, or a smartphone application as two non-limiting examples. Switching between the modes could also be done automatically, for example by detecting the level of ambient noise in the environment, and selecting a mode based on that noise level. FIG. 8 illustrates a simplified view of a system diagram 70 with digital signal processor (DSP) 72 that performs the filtering needed to accomplish each of the modes. An audio signal is inputted to DSP 72, where overall equalization (EQ) is performed by function 74. The equalized signal is provided to each of left A and B filters and right A and B filters 75-78, respectively. Filters 75-78 apply any filters needed to accomplish the result of the selected mode. Further DSP functionality 79-82 can accomplish other sorts of limiters, compressors, dynamic equalization or other functions known in the art. Amplifiers 83-86 provide amplified signals to left A and B and right A and B transducers 87-90, respectively.

To illustrate benefits of the acoustic device, data will be presented concerning a simplified representation that comprises a sphere in free space with a radius of 0.1 meters, which is intended to roughly approximate a human head. At the outside surface of the sphere is a microphone location to represent the ear. Directly above the microphone location are idealized acoustic point sources A and B, as in FIG. 2. The distances x and D for this example are approximately 0.025 m and 0.050 m, respectively.

The reference in the subsequent analysis and in the plots of FIGS. 10-14 (curve "A") is the output only from source A, with no output from source B. In situations where both sides of the head are active, the source A output is in phase on both sides of the head. This represents a more conventional headphone acoustic architecture with just one transducer on each side of the head. The following analysis represents the magnitude of deviation from this conventional setup and from the reference scenario.

To understand the basic impact of phase relationships on cancellation, we will first look at just the two sources, which represent two speakers above the ear on just one side of the head. We will look at different configurations with different phase relationships between source A and source B. The configurations are as follows: Source B in phase with source A (curve "B" in FIGS. 10 and 11), Source A alone as reference (no output from B) (curve "A" in FIGS. 10 and 11), and source B 180° out of phase with source A (curve "C" in FIGS. 10 and 11).

Figure 10:
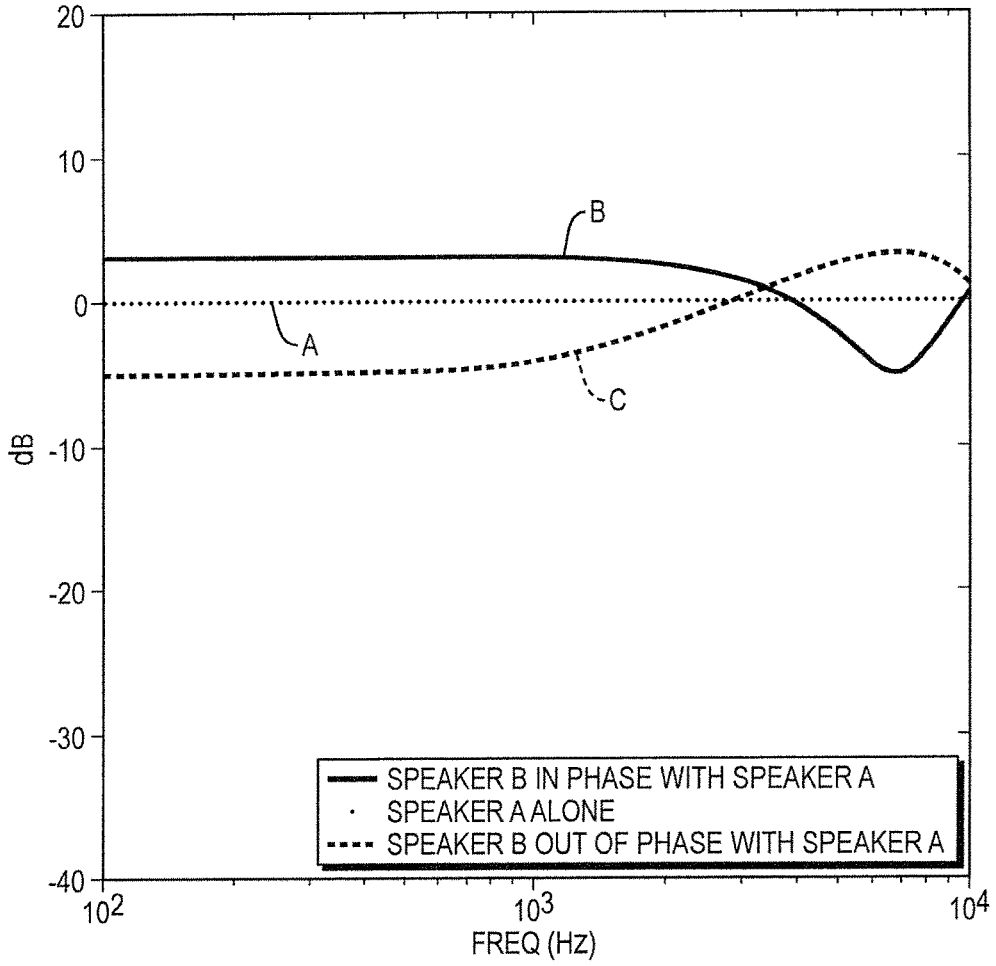
FIG. 10 is a plot illustrating relative pressure at the ear for an acoustic device.

FIG. 10 shows the pressure at the microphone for each of these configurations versus the reference (source A alone). This shows the different levels of relative gain of the audio signal delivered to the ear by modulating the phase of the two sources. At low frequencies, the "in-phase" configuration is capable of delivering approximately 3 dB more output to the ear (for an equal limit on the volume velocity coming from each source).

Figure 11:
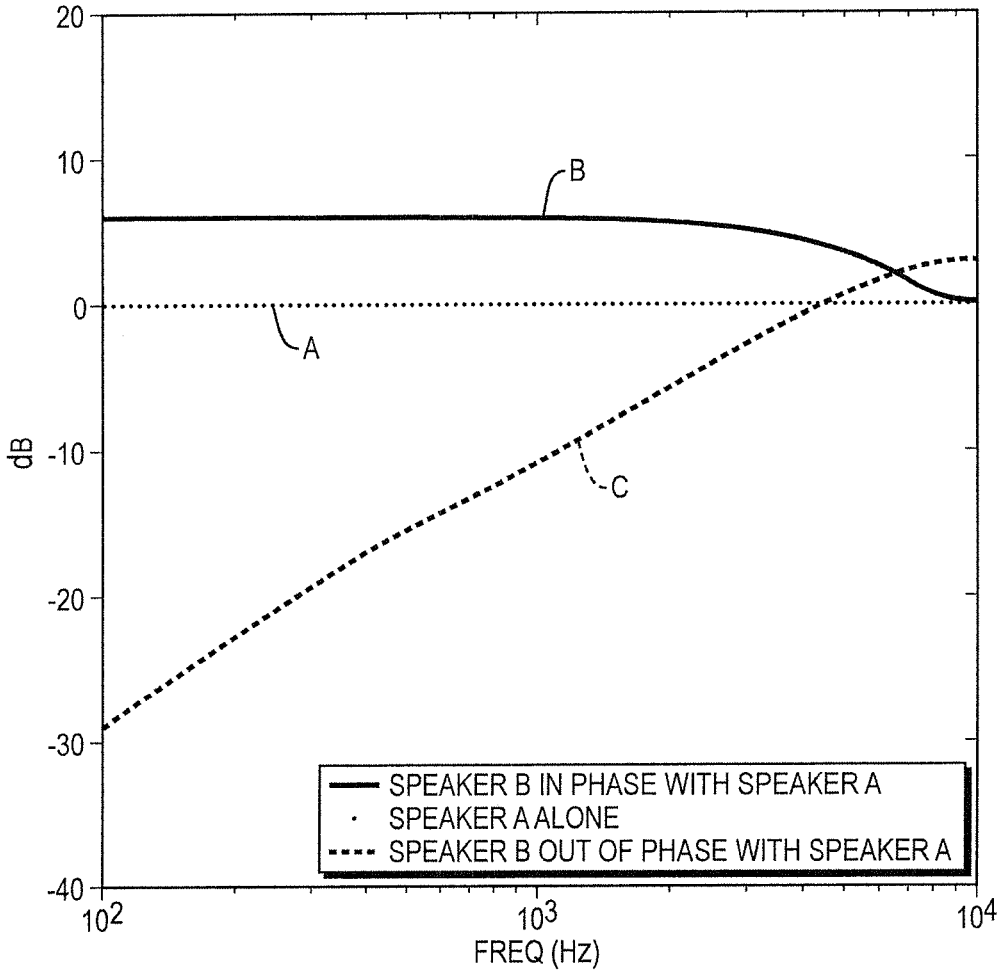
FIG. 11 is a plot illustrating radiated power for an acoustic device.

FIG. 11 shows the total power radiated from the acoustic device, which represents the acoustic "spillage" that escapes to the environment. This illustrates the dramatic effect of a 180° phase difference on the far-field radiation of two sources. For example, at 100 Hz the "out of phase" configuration is radiating almost 30 dB less power to the environment than a single source, with spillage being reduced at some level at frequencies up to about 3.5 kHz.

FIGS. 10 and 11 illustrate benefits of increased SPL capability from driving in-phase, and the reduced radiation capability of driving the sources out of phase.

Now we will add a symmetric pair of sources on the other side of the sphere such that there are four sources, to allow simulation of the different modes described above.

Figure 12:
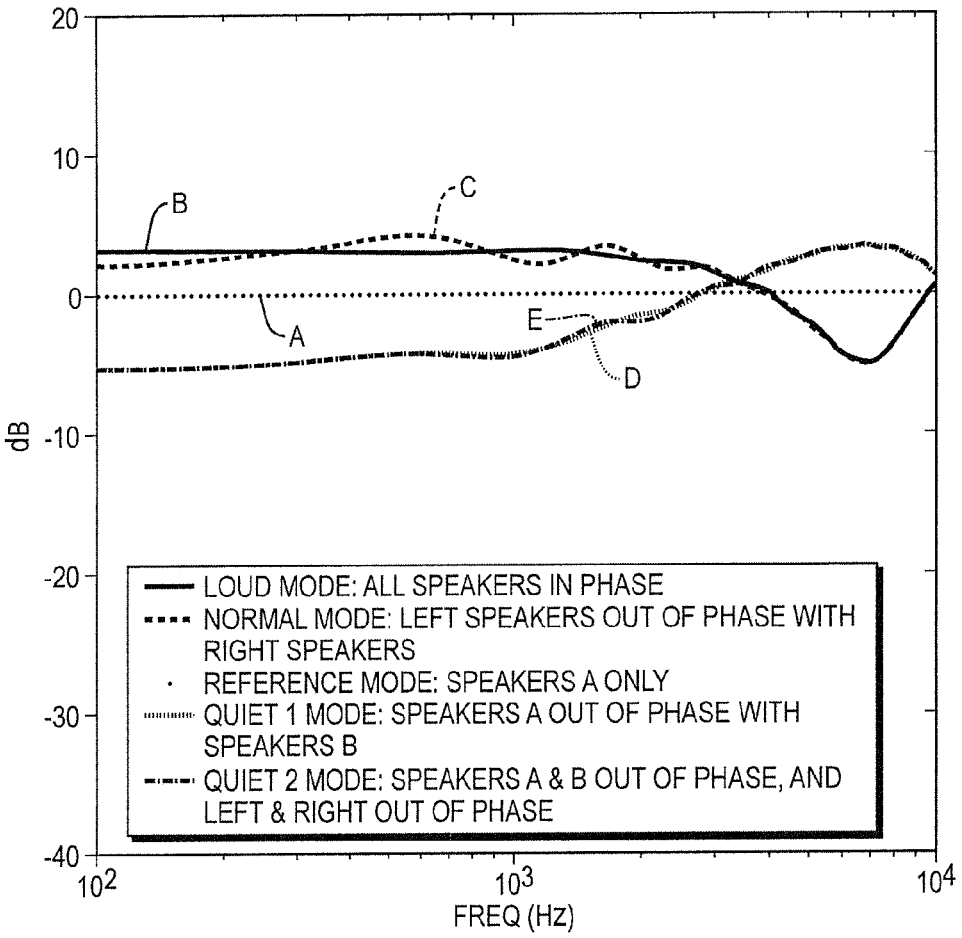
FIG. 12 is a plot illustrating relative pressure at the ear for different operating modes of an acoustic device.

FIG. 12 shows the differences in microphone pressure at the ear between several example modes. Assuming that in a practical situation all transducers have the same volume velocity limit, this represents the differences in the capability of each example mode to create SPL at the ear. The "Loud" mode (all speakers in phase, curve "B" in FIGS. 12-14) is capable of producing approximately 3 dB more pressure than a conventional headset (reference mode, curve "A"). The "normal" mode (left speakers out of phase with right speakers) is shown in curve "C", FIGS. 12-14. Quiet 1 mode (speakers A out of phase with speakers B, curve "D" in FIGS. 12-14) and Quiet 2 mode (speakers A and B out of phase and left and right out of phase, curve "E" in FIGS. 12-14) are also shown.

Figure 13:
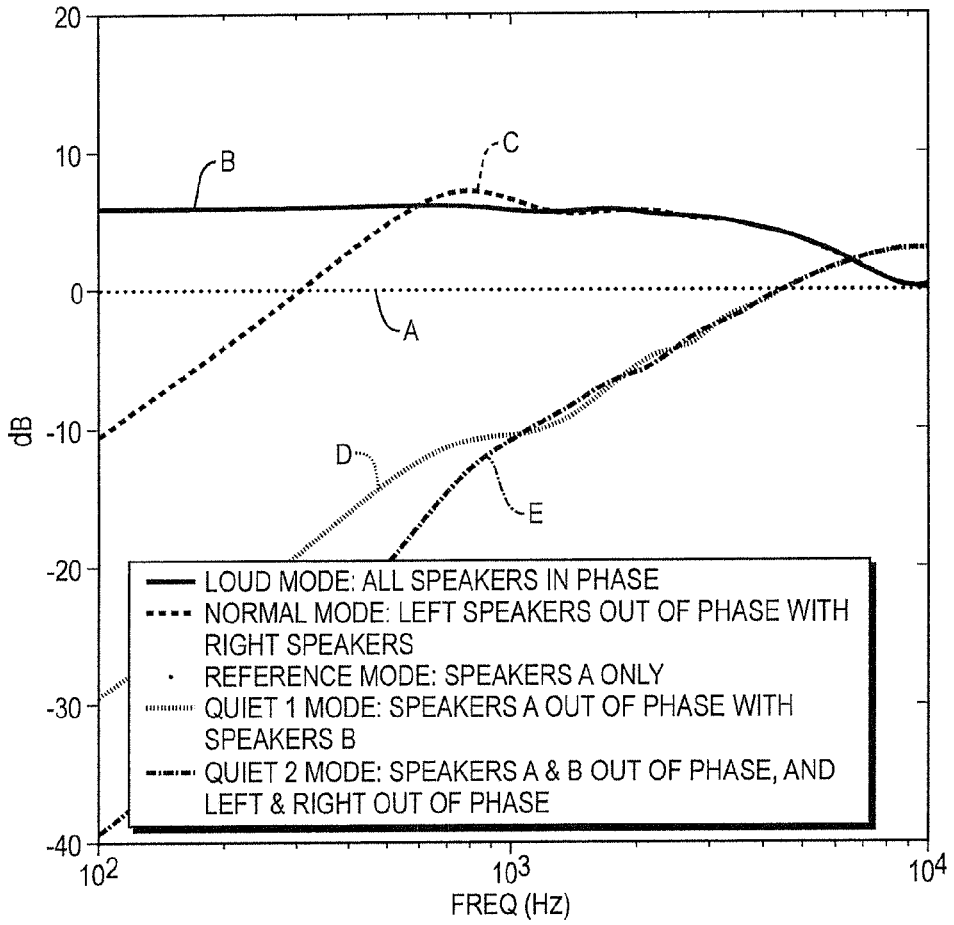
FIG. 13 is a plot illustrating radiated power for different operating modes of an acoustic device.

FIG. 13 shows the relative radiated acoustic power for the same several example modes of the acoustic device as shown in FIG. 12, with the curves labeled with the same convention as in FIG. 12. This represents the radiation to the environment. In some use cases, lower radiation is beneficial. The figure shows that the far-field cancellation benefit of both Quiet modes is quite substantial (almost 40 dB of benefit at 100 Hz, with spillage being reduced at some level at frequencies up to about 3.5 kHz) and even normal mode achieves almost 10 dB of benefit at 100 Hz, with spillage being reduced at some level at frequencies up to about 350 Hz.

Figure 14:
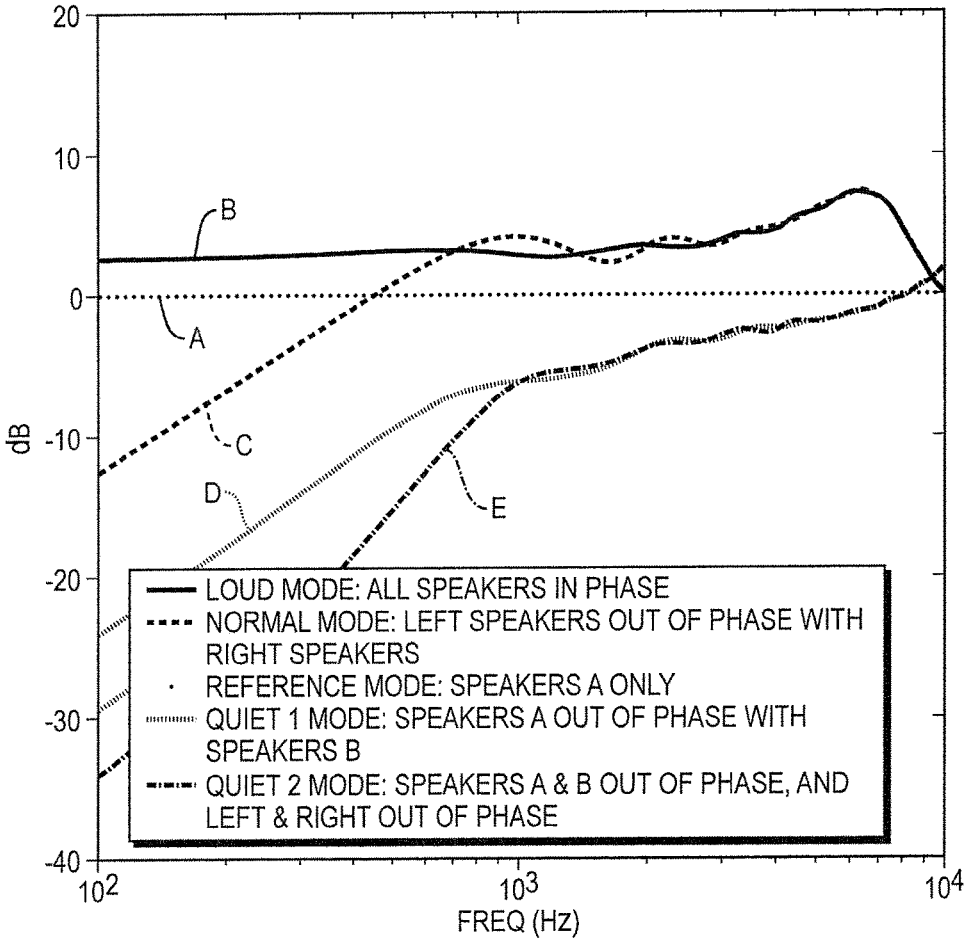
FIG. 14 is a plot illustrating radiated power divided by the square of the microphone pressure for different operating modes of an acoustic device.

Radiated power and microphone pressure are viewed separately above, but an expression that captures the "sound delivered to the ear" relative to the "sound spilled to the environment" tells a fuller story of the magnitude of the benefits that the acoustic device provides. FIG. 14 shows just this, and plots the radiated power divided by the square of the microphone pressure for the same several example modes of the acoustic device as shown in FIGS. 12 and 13, with the curves labeled with the same convention as in FIGS. 12 and 13:

$$\frac{W_{radiated}}{P_{mic}^2} \quad \text{(equation 5)}$$

The lower this metric, the higher the SPL the system can deliver to the user for a given level of "disturbance" to the environment.

FIG. 14 shows that the Normal, Quiet 1, and Quiet 2 modes each offer improvements in cancellation across varying frequency ranges. Quiet 2 mode shows the best cancellation performance with almost 35 dB of far-field attenuation at 100 Hz and with spillage being reduced at even higher frequencies.

In summary, each of these modes provides a different set of trade-offs between maximum SPL and far-field cancellation and as such the acoustic device provides the user a highly versatile and configurable set of possible benefits.

The acoustic device is able to meet the needs of many varied use cases with the same acoustic architecture. Some examples include the following. Use cases that require low spillage and do not require high SPL; examples include an office setting or public space where privacy and conscientiousness are important to the user. Use cases that require higher SPL but do not require low spillage; examples include riding a bike, running, or washing dishes at home. These situations often involve environmental noise that masks the desired audio. Use cases where sharing audio content with others is important and there is a desire to deliver audio to those nearby as well.

The ability to achieve multiple modes in a single acoustic solution increases the flexibility of the acoustic device, and extends the use across many applications.

A patent application entitled "Acoustic Device," inventors Zhen Sun, Raymond Wakeland and Carl Jensen, filed on the same date herewith (and incorporated fully herein by reference), discloses an acoustic device that is also constructed and arranged to reduce spillage at certain frequencies. The acoustic device disclosed in the application incorporated by reference could be combined with the acoustic device disclosed herein in any logical or desired manner, so as to achieve additional and possibly broader band spillage reduction.

An acoustic device of the present disclosure can be accomplished in many different form factors. Following are several non-limiting examples. The transducers could be in a housing on each side of the head and connected by a band such as those used with more conventional headphones, and the location of the band could vary (e.g., on top of the head, behind the head or elsewhere). The transducers could be in a neck-worn device that sits on the shoulders/upper torso, such as depicted in U.S. patent application Ser. No. 14/799,265 (Publication No. 2016-0021449), filed on Jul. 14, 2015, the disclosure of which is incorporated fully herein by reference. The transducers could be in a band that is flexible and wraps around the head. The transducers could be integral with or coupled to a hat, helmet or other head-worn device. This disclosure is not limited to any of these or any other form factor, and other form factors could be used.

Figure 15:
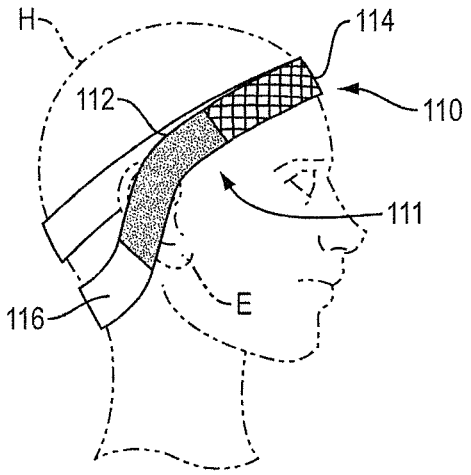
FIGS. 15 and 16 illustrate a head-worn acoustic device.
Figure 16:
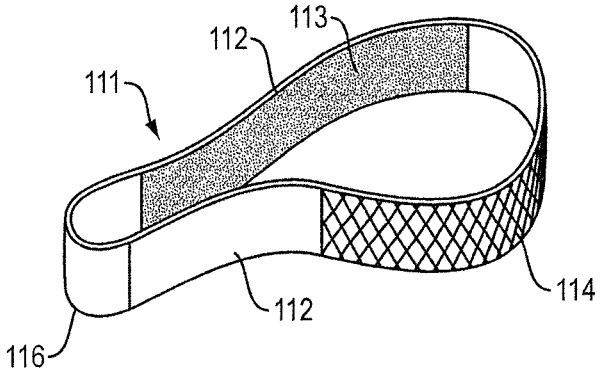

An alternative acoustic device 110 is shown in FIGS. 15 and 16. Acoustic device 110 comprises a band 111 that sits on the head H, above the ears E. Preferably but not necessarily, band 111 does not touch or cover the ears. Band 111 is constructed and arranged to grip head H. Device 110 includes loudspeakers (not shown) carried by band 111 such that they sit above or behind each ear E, with the loudspeakers preferably but not necessarily arranged in a manner such as those described above. Band 111 is constructed and arranged to be stretched so that it can fit over the head, while at the same time the stretchiness grips the head so that device 110 remains in place.

Band 111 includes two rigid portions 112, one located above each ear. Portions 112 preferably each house a stereo acoustic system comprising an antenna, electronics and the loudspeakers. Rigid portions 112 preferably have an offset curve shape as shown in FIG. 15, such that device 110 does not touch the ears. Band 111 further includes a flexible, stretchable portion 114 that connects portions 112 and spans the front of the head. Portion 114 accomplishes a comfortable fit on a wide range of head shapes. Band 111 also includes semi-rigid portion 116 that connects portions 112 and spans the back of the head. Alternative bands can replace portion 116 with another flexible portion (like portion 114), or the rigid portion could extend over both ears and continue behind the head.

Band 111 is preferably a continuous band that is stretched to a larger circumference to fit over the head while also applying pressure to the head, to firmly hold device 110 on the head. The circumferential grip of the headband maximizes the contact area over which the head is compressed and therefore reduces the pressure applied to the head for a given amount of frictional hold.

Band 111 can be assembled from discrete portions. Rigid portions 112 can be made of rigid materials (e.g., plastic and/or metal). Flexible portion 114 can be made of compliant materials (e.g., cloth, elastic, and/or neoprene). Semi-rigid portion 116 can be made of compliant but relatively stiff materials (e.g., silicone, thermoplastic elastomer and/or rubber). Rigid portion 114 provides allowances for enclosing the electronics and the speakers, as well as creating the desired relatively rigid "ear-avoidance" offset to band 111. Flexible portion 114 creates compliance, preferably such that there is a relatively uniform compressive force on the head that will allow a comfortable fit for a wide variety of head circumferences. Semi-rigid portion 116 allows for bending band 111, to accomplish a smaller, more portable packed size. Also, semi-rigid portion 116 can house wiring and/or an acoustic waveguide that can be used to electrically and/or acoustically couple the electronics and/or speakers in the two portions 112; this arrangement could also allow the necessary electronics to be housed in only one portion 112, or do away with the redundancy in the electronics that would be needed if the two portions 112 were not electrically coupled.

The rigid and/or or semi-rigid portions preferably carry along their inside surfaces a cushion 113 that creates a compliant distribution of force, so to reduce high pressure peaks. Due to the desire for high frictional retention as well as small size, one possible cushion construction is to use patterned silicone rubber cushions (see, e.g., FIG. 16) designed such that the compliance normal to the surface will be minimized and the patterning features increase the mechanical retention on the head and hair.

Audio device 110 is able to deliver quality audio to runners and athletes, while leaving the ears open and acoustically un-occluded for improved audio awareness and safety. Also, since nothing touches the ears, comfort issues sometimes associated with in-ear products (e.g., pressure and heat), are eliminated. Also, the contact area with the head is maximized, which reduces pressure on the head for improved comfort over other form factors. The stability, accomplished via gripping the head circumferentially with soft materials, reduces problems associated with the retention stability of in-ear products.

Elements of FIG. 8 are shown and described as discrete elements in a block diagram. These may be implemented as one or more of analog circuitry or digital circuitry. Alternatively, or additionally, they may be implemented with one or more microprocessors executing software instructions. The software instructions can include digital signal processing instructions. Operations may be performed by analog circuitry or by a microprocessor executing software that performs the equivalent of the analog operation. Signal lines may be implemented as discrete analog or digital signal lines, as a discrete digital signal line with appropriate signal processing that is able to process separate signals, and/or as elements of a wireless communication system.

When processes are represented or implied in the block diagram, the steps may be performed by one element or a plurality of elements. The steps may be performed together or at different times. The elements that perform the activities may be physically the same or proximate one another, or may be physically separate. One element may perform the actions of more than one block. Audio signals may be encoded or not, and may be transmitted in either digital or analog form. Conventional audio signal processing equipment and operations are in some cases omitted from the drawing.

A number of implementations have been described. Nevertheless, it will be understood that additional modifications may be made without departing from the scope of the inventive concepts described herein, and, accordingly, other embodiments are within the scope of the following claims.

What is claimed is:

1. An acoustic device that is adapted to be worn close to each side of the head and off the ears comprising:

a first enclosure comprising a first acoustic transducer and a second acoustic transducer, wherein the first and second transducers each radiate sound from both their front sides and their opposed back sides, wherein the first and second transducers are each coupled to the first enclosure such that their back sides are acoustically coupled to a common acoustic volume of the first enclosure, and wherein the first transducer is closer to the expected location of a first ear of the user than is the second transducer; a second enclosure comprising a third acoustic transducer and a fourth acoustic transducer, wherein the third and fourth transducers each radiate sound from both their front sides and their opposed back sides, wherein the third and fourth transducers are each coupled to the second enclosure such that their back sides are acoustically coupled to a common acoustic volume of the second enclosure, and wherein the third transducer is closer to the expected location of a second ear of the user than is the fourth transducer; and a controller that is adapted to independently control the phase of the first, second, third and fourth transducers to establish multiple operating modes for the acoustic device.

2. The acoustic device of claim 1, wherein the multiple operating modes comprise a quiet operating mode, a normal operating mode, and a loud operating mode.

3. The acoustic device of claim 2, wherein in the quiet operating mode, the first and second transducers are played out of phase from each other, and the third and fourth transducers are played out of phase from each other.

4. The acoustic device of claim 3, wherein in the quiet operating mode, the first and third transducers are played in phase with each other, and the second and fourth transducers are played in phase with each other.

5. The acoustic device of claim 3, wherein in the quiet operating mode, the first and third transducers are played out of phase with each other, and the second and fourth transducers are played out of phase with each other.

6. The acoustic device of claim 2, wherein in the normal operating mode, the first and second transducers are played in phase with each other, and the third and fourth transducers are played in phase with each other, and where the first and second transducers are played out of phase with the third and fourth transducers.

7. The acoustic device of claim 2, wherein in the loud operating mode, all four transducers are played in phase with each other.

8. The acoustic device of claim 2, wherein the quiet operating mode, normal operating mode, or loud operating mode is selected in response to a user request to change a volume of audio output by the acoustic device.

9. The acoustic device of claim 2, wherein the quiet operating mode, normal operating mode, or loud operating mode is selected in response to a user input selecting one of the modes.

10. The acoustic device of claim 2, wherein the quiet operating mode, normal operating mode, or loud operating mode is selected in response to detecting a level of ambient noise in the environment of the acoustic device.

11. The acoustic device of claim 1, wherein the first acoustic transducer is adapted to radiate sound from its front side along a first sound axis and the second acoustic transducer is adapted to radiate sound from its front side along a second sound axis, where the first sound axis is pointed generally toward the expected location of the first ear and the second sound axis is pointed generally away from the expected location of the first ear, and wherein the third acoustic transducer is adapted to radiate sound from its front side along a third sound axis and the fourth acoustic transducer is adapted to radiate sound from its front side along a fourth sound axis, where the third sound axis is pointed generally toward the expected location of the second ear and the fourth sound axis is pointed generally away from the expected location of the second ear.

12. The acoustic device of claim 1, wherein the first acoustic transducer is adapted to radiate sound from its front side along a first sound axis and the second acoustic transducer is adapted to radiate sound from its front side along a second sound axis, where the first and second sound axes are both pointed generally toward the expected location of the head proximate the first ear, and wherein the third acoustic transducer is adapted to radiate sound from its front side along a third sound axis and the fourth acoustic transducer is adapted to radiate sound from its front side along a fourth sound axis, where the third and fourth sound axes are both pointed generally toward the expected location of the head proximate the second ear.

13. The acoustic device of claim 1, wherein the second transducer is at least about two times farther from the first ear than is the first transducer.

14. The acoustic device of claim 1, further comprising a first resonant element coupled to the first enclosure and a second resonant element coupled to the second enclosure, wherein the first and second resonant elements each comprises a port, a passive radiator, or a waveguide, and wherein the first and second resonant elements are each acoustically coupled to the common acoustic volume of the respective enclosure.

15. The acoustic device of claim 14, wherein the first and second resonant elements each have an acoustic output, and wherein the output of the first resonant element is proximate a first ear of a wearer, and the output of the second resonant element is proximate a second ear of the wearer.

16. The acoustic device of claim 15, wherein the first and second resonant elements each comprise a port with an open end proximate an ear.

17. An acoustic device that is adapted to be worn close to each side of the head and off the ears comprising:

a first enclosure comprising a first acoustic transducer and a second acoustic transducer, where the first transducer is closer to the expected location of a first ear of the user than is the second transducer, and the second transducer is at least about two times farther away from the first ear than is the first transducer; a second enclosure comprising a third acoustic transducer and a fourth acoustic transducer, where the third transducer is closer to the expected location of a second ear of the user than is the fourth transducer, and the fourth transducer is at least about two times farther away from the second ear than is the third transducer; and a controller that is adapted to independently control the phase of the first, second, third and fourth transducers, and is further adapted to establish first, second and third different signal processing modes for the acoustic device.

18. The acoustic device of claim 17, wherein in the first signal processing mode, the first and second transducers are played out of phase from each other, and the third and fourth transducers are played out of phase from each other.

19. The acoustic device of claim 17, wherein in the second signal processing mode, the first and second transducers are played in phase with each other, and the third and fourth transducers are played in phase with each other, and where the first and second transducers are played out of phase with the third and fourth transducers.

20. The acoustic device of claim 17, wherein in the third signal processing mode, all four transducers are played in phase with each other.

21. The acoustic device of claim 17, wherein the first, second or third signal processing mode is selected in response to a user request to change a volume of audio output by the acoustic device.

22. The acoustic device of claim 17, wherein the first, second or third signal processing mode is selected in response to a user input selecting one of the modes.

23. The acoustic device of claim 17, wherein the first, second or third signal processing mode is selected in response to detecting a level of ambient noise in the environment of the acoustic device.

24. The acoustic device of claim 1, further comprising a waveguide that is acoustically coupled to the common acoustic volumes of both the first and second enclosures, wherein the waveguide comprises an exit for air.

25. The acoustic device of claim 2, further comprising low-pass filters for the second and fourth transducers in the quiet operating mode wherein the low-pass filters are configured to reduce the acoustic radiation above a knee frequency.

* * * * *